US010859073B2

(12) United States Patent
Nong

(10) Patent No.: US 10,859,073 B2
(45) Date of Patent: Dec. 8, 2020

(54) RECIPROCATING PUMP INJECTOR

(71) Applicant: PICOSPRAY, INC., Ann Arbor, MI (US)

(72) Inventor: Lihang Nong, Ann Arbor, MI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 493 days.

(21) Appl. No.: 15/660,265

(22) Filed: Jul. 26, 2017

(65) Prior Publication Data

US 2018/0030969 A1 Feb. 1, 2018

Related U.S. Application Data

(60) Provisional application No. 62/367,431, filed on Jul. 27, 2016.

(51) Int. Cl.

| | |
|---|---|
| ***F04B 17/04*** | (2006.01) |
| ***F02M 51/04*** | (2006.01) |
| ***F02M 51/06*** | (2006.01) |

(52) U.S. Cl.

CPC ..... *F04B 17/046* (2013.01); *F02M 51/04* (2013.01); *F04B 17/044* (2013.01); *F02M 51/0625* (2013.01)

(58) Field of Classification Search

CPC ..... F04B 17/046; F04B 17/04; F04B 53/12–53/129; F04B 35/045; F04B 17/044; F02M 51/04

See application file for complete search history.

(56) References Cited

U.S. PATENT DOCUMENTS

| | | | | |
|---|---|---|---|---|
| 4,116,591 | A | 9/1978 | Mardell | |
| 4,121,125 | A | 10/1978 | Dolz | |
| 4,327,695 | A | 5/1982 | Schechter | |
| 4,410,302 | A * | 10/1983 | Chiba | F04B 53/06 417/299 |
| 4,463,900 | A | 8/1984 | Wich | |
| 4,505,243 | A | 3/1985 | Miwa | |
| 4,915,602 | A | 4/1990 | Tschopp | |
| 5,107,890 | A | 4/1992 | Gute | |

(Continued)

FOREIGN PATENT DOCUMENTS

| | | |
|---|---|---|
| EP | 0 752 148 | 1/1997 |
| EP | 1 248 494 | 10/2002 |

(Continued)

OTHER PUBLICATIONS

Australian First Examination Report regarding Application No. 2013334273 (6 pages).

(Continued)

*Primary Examiner* — Bryan M Lettman

(74) *Attorney, Agent, or Firm* — Foley & Lardner LLP

(57) ABSTRACT

A reciprocating piston pump includes a pumping chamber, an inlet valve through which fuel passes to enter the pumping chamber, a piston configured to pressurize the fuel entering the pumping chamber, an outlet valve through which the pressurized fuel passes to exit the pumping chamber, and a solenoid actuator assembly coupled to the piston. The solenoid actuator assembly includes a fixed stator, a coil, and a movable armature. The movable armature is configured to move toward a first end of the fixed stator in response to the coil being energized.

20 Claims, 7 Drawing Sheets

(56) References Cited

U.S. PATENT DOCUMENTS

| | | | |
|---|---|---|---|
| 5,351,893 | A | 10/1994 | Young |
| 5,390,257 | A | 2/1995 | Oslac et al. |
| 5,469,828 | A | 11/1995 | Heimberg et al. |
| 5,472,323 | A | 12/1995 | Hirabayashi et al. |
| 5,511,955 | A | 4/1996 | Brown et al. |
| 5,630,401 | A | 5/1997 | Binversie et al. |
| 5,704,771 | A | 1/1998 | Fujisawa et al. |
| 5,781,363 | A | 7/1998 | Rowan et al. |
| 5,898,786 | A | 4/1999 | Geisenberger |
| 6,081,112 | A | 6/2000 | Carobolante et al. |
| 6,135,357 | A | 10/2000 | Herrin et al. |
| 6,279,843 | B1 | 8/2001 | Coldren et al. |
| 6,290,308 | B1 | 9/2001 | Zitzelsberger |
| 6,373,957 | B1 | 4/2002 | Stewart |
| 6,394,367 | B2 | 5/2002 | Munezane et al. |
| 6,422,836 | B1 | 7/2002 | Krueger |
| 6,614,617 | B1 | 9/2003 | Galloway |
| 6,877,679 | B2 | 4/2005 | Lawes |
| 6,923,163 | B2 | 8/2005 | Yamazaki |
| 6,964,263 | B2 | 11/2005 | Xi et al. |
| 6,966,760 | B1 | 11/2005 | Radue |
| 7,100,578 | B2 | 9/2006 | Yamazaki et al. |
| 7,267,533 | B1 | 9/2007 | Tocci et al. |
| 7,287,966 | B2 | 10/2007 | French et al. |
| 7,309,025 | B2 | 12/2007 | Yamazaki et al. |
| 7,377,266 | B2 | 5/2008 | Xi et al. |
| 7,410,347 | B2 | 8/2008 | Radue |
| 7,438,050 | B2 | 10/2008 | Allen |
| 7,533,655 | B2 | 5/2009 | Allen |
| 7,753,657 | B2 | 7/2010 | Strauss et al. |
| 7,798,130 | B2 | 9/2010 | Allen |
| 7,866,301 | B2 | 1/2011 | Venkataraghavan et al. |
| 8,079,825 | B2 | 12/2011 | Bocchiola |
| 2005/0263135 | A1 | 12/2005 | Magel et al. |
| 2006/0097067 | A1 | 5/2006 | Buehler et al. |
| 2006/0124775 | A1 | 6/2006 | Harcombe |
| 2007/0095934 | A1 | 5/2007 | Wisdom |
| 2009/0108093 | A1 | 4/2009 | Mattes et al. |
| 2010/0011578 | A1 | 1/2010 | Beck et al. |
| 2010/0193611 | A1 | 8/2010 | Burger et al. |
| 2010/0236526 | A1 | 9/2010 | Wang et al. |
| 2010/0312453 | A1 | 12/2010 | Smither |
| 2012/0244022 | A1* | 9/2012 | Nakai ..... F04B 17/042 417/410.1 |
| 2014/0117121 | A1* | 5/2014 | Nong ..... F02M 51/061 239/584 |

FOREIGN PATENT DOCUMENTS

| | | |
|---|---|---|
| EP | 1 367 225 | 12/2003 |
| EP | 2 198 140 | 6/2010 |
| GB | 2452955 | 3/2009 |

OTHER PUBLICATIONS

Corrected International Search Report and Written Opinion for Application No. PCT/US2013/066703, dated Jul. 28, 2014, 13 pages.

EP Extended Search Report dated May 17, 2016 regarding EP Application No. 13849666.6 (6 pgs).

International Preliminary Report on Patentability dated Nov. 24, 2014 regarding Application No. PCT/US13/66703; 6 pgs.

International Search Report and Written Opinion dated Feb. 10, 2014 in relate PCT Application No. PCT/US2013/066703.

* cited by examiner

RECIPROCATING PUMP INJECTOR

CROSS-REFERENCE TO RELATED PATENT APPLICATIONS

This application claims the benefit of and priority to U.S. Provisional Application No. 62/367,431, filed Jul. 27, 2016, the entire disclosure of which is hereby incorporated by reference herein.

BACKGROUND

The present application relates generally to the field of internal combustion engines. More particularly, the present application relates to fuel injection systems for internal combustion engines.

Fuel injection systems can provide fuel to an internal combustion engine. A typical fuel injection system includes a high pressure fuel pump and an injector. The fuel pump is typically a separate and distinct component from the injector. The fuel pump can provide pressurized fuel from a tank to the injector, and the injector can meter the fuel into the air intake or combustion chamber. A typical fuel injector uses a solenoid or piezoelectric system to move a needle, thereby permitting or preventing flow of the pressurized fuel through the fuel injector to an outlet nozzle. Internal combustion engines using fuel injection systems typically have cleaner emissions than carbureted; however, in many small engines, and in many parts of the world, carburetors are still widely used due to the cost and complexity of fuel injection systems.

It would be advantageous to provide a fuel injector including an integrated fuel pump to simplify the fuel injection system and reduce the number of components in the system, thereby reducing cost. These and other advantageous features will become apparent to those reviewing the present disclosure.

SUMMARY

One embodiment relates to a fuel injector including a sleeve having a first end proximate an outlet nozzle; a piston received in the sleeve and slidable between a first position and a second position, the piston having a first end proximate the outlet nozzle; a pumping chamber at least partially defined by the sleeve between the first end of the piston and the outlet nozzle; and an inlet valve through which fuel passes to enter the pumping chamber. The fuel injector may include an inlet check valve and outlet check valve coupled to the first end of the sleeve. The inlet valve may be located in the piston. The piston may include a wall coupled to the inlet valve, the wall and the inlet valve at least partially defining a cavity in the piston, wherein fuel passes through the cavity to enter the pumping chamber. The fuel injector may include a magnetic actuation assembly supported by the housing and coupled to the piston, the magnetic actuation assembly configured to translate the piston. The magnetic actuation assembly may include a radial gap and an axial gap located between the armature and the stator on the same end of the stator. The magnetic flux through the radial gap may be parallel to the magnetic flux through the axial gap. The magnetic flux through the radial gap may increase as the axial gap is reduced. The magnetic actuation assembly may provide a substantially constant force through its intended range of travel for consistent flow rate and ease of calibration. The armature and piston may be loosely coupled together to allow for relative movement to reduce the sideways magnetic force transferred to the piston. The fuel injector may include two ports to cycle liquid fuel and fuel vapor through the injector. The outlet nozzle may include a thin plate with an indent to support the outlet check valve spring and one or more orifices to atomize fuel.

Another embodiment relates to a reciprocating piston pump for delivering fuel to an internal combustion engine including a pumping chamber, an inlet valve through which fuel passes to enter the pumping chamber, a piston configured to pressurize the fuel entering the pumping chamber, an outlet valve through which pressurized fuel passes to exit the pumping chamber, and a solenoid actuator assembly coupled to the piston. The solenoid actuator assembly includes a fixed stator, a coil, and a movable armature configured to move toward a first end of the fixed stator in response to the coil being energized. The solenoid actuator assembly includes a magnetic flux path that passes substantially between the movable armature and the fixed stator via a radial gap and an axial gap that are defined at least in part by the first end of the stator. The movable armature is configured to move relative to the fixed stator to reduce the axial gap and to increase a magnetic flux through the radial gap such that a total axial force acting on the movable armature is substantially constant through a substantial portion of travel of the movable armature. The piston is configured to move to force pressurized fuel out of the outlet valve in response to the axial gap changing in size as the movable armature moves relative to the fixed stator.

In some exemplary embodiments, the piston and the movable armature are configured to move relative to each other in at least a radial direction.

In some exemplary embodiments, the piston and the movable armature are fixed relative to each other in at least an axial direction.

In some exemplary embodiments, the reciprocating piston pump further comprises a plate coupled to the pumping chamber and including one or more orifices, wherein the piston is configured to move pressurized fuel through the one or more orifices of the plate.

In some exemplary embodiments, the outlet valve includes a helical spring configured to bias the outlet valve to a normally closed position.

In some exemplary embodiments, the inlet valve includes a valve body and a valve seat, and wherein the valve body has a poppet shape and the valve seat is coupled to the piston.

In some exemplary embodiments, the piston is configured to limit movement of the armature, and the piston is configured to reach a downward limit before the armature.

In some exemplary embodiments, the armature includes at least one axial slot to permit fuel to pass therethrough.

In some exemplary embodiments, the inlet valve includes a valve body that is biased by a spring member to a normally open position.

In some exemplary embodiments, the average cross-sectional area of the radial gap adjacent the fixed stator increases as the movable armature moves to reduce the axial gap.

In some exemplary embodiments, wherein the fixed stator becomes less magnetically saturated as the movable armature moves to reduce the axial gap.

Another embodiment relates to a reciprocating piston pump for delivering fuel to an internal combustion engine including a pumping chamber, an inlet valve through which fuel passes to enter the pumping chamber, a piston configured to pressurize the fuel entering the pumping chamber, an outlet valve through which pressurized fuel passes to exit the pumping chamber, and a solenoid actuator assembly configured to move the piston. The solenoid actuator assembly includes a fixed stator, a coil, and a movable armature configured to move relative to the fixed stator in response to the coil being energized. The piston and the movable armature are configured to move relative to each other in a radial direction. The piston and the movable armature are fixed relative to each other in an axial direction.

In some exemplary embodiments, the solenoid actuator assembly includes a magnetic flux path that passes substantially between the movable armature and the fixed stator via a radial gap and an axial gap, wherein the radial gap and the axial gap are defined at least in part by one or more surfaces of the fixed stator, wherein the piston is configured to force the pressurized fuel out of the outlet valve in response to the axial gap changing in size as the movable armature moves relative to the fixed stator, and wherein the movable armature is configured to move relative to the fixed stator to reduce the axial gap and to increase a magnetic flux through the radial gap such that a total axial force acting on the movable armature is substantially constant through a substantial portion of travel of the movable armature.

In some exemplary embodiments, the reciprocating piston pump further comprises a plate coupled to the pumping chamber and including one or more orifices, wherein the piston is configured to force pressurized fuel through the one or more orifices.

In some exemplary embodiments, the outlet valve includes a helical spring configured to bias the outlet valve to a normally closed position.

In some exemplary embodiments, the inlet valve includes a valve body and a valve seat, and wherein the valve body has a poppet shape and the valve seat is coupled to the piston.

In some exemplary embodiments, the movable armature includes at least one axial slot to permit fuel to pass therethrough.

In some exemplary embodiments, the inlet valve includes a valve body that is biased by a spring member to a normally open position.

In some exemplary embodiments, the average cross-sectional area of the radial gap adjacent the stator increases as the movable armature moves to reduce the axial gap.

In some exemplary embodiments, wherein the stator becomes less magnetically saturated as the movable armature moves to reduce the axial gap.

DETAILED DESCRIPTION

Figure 1:
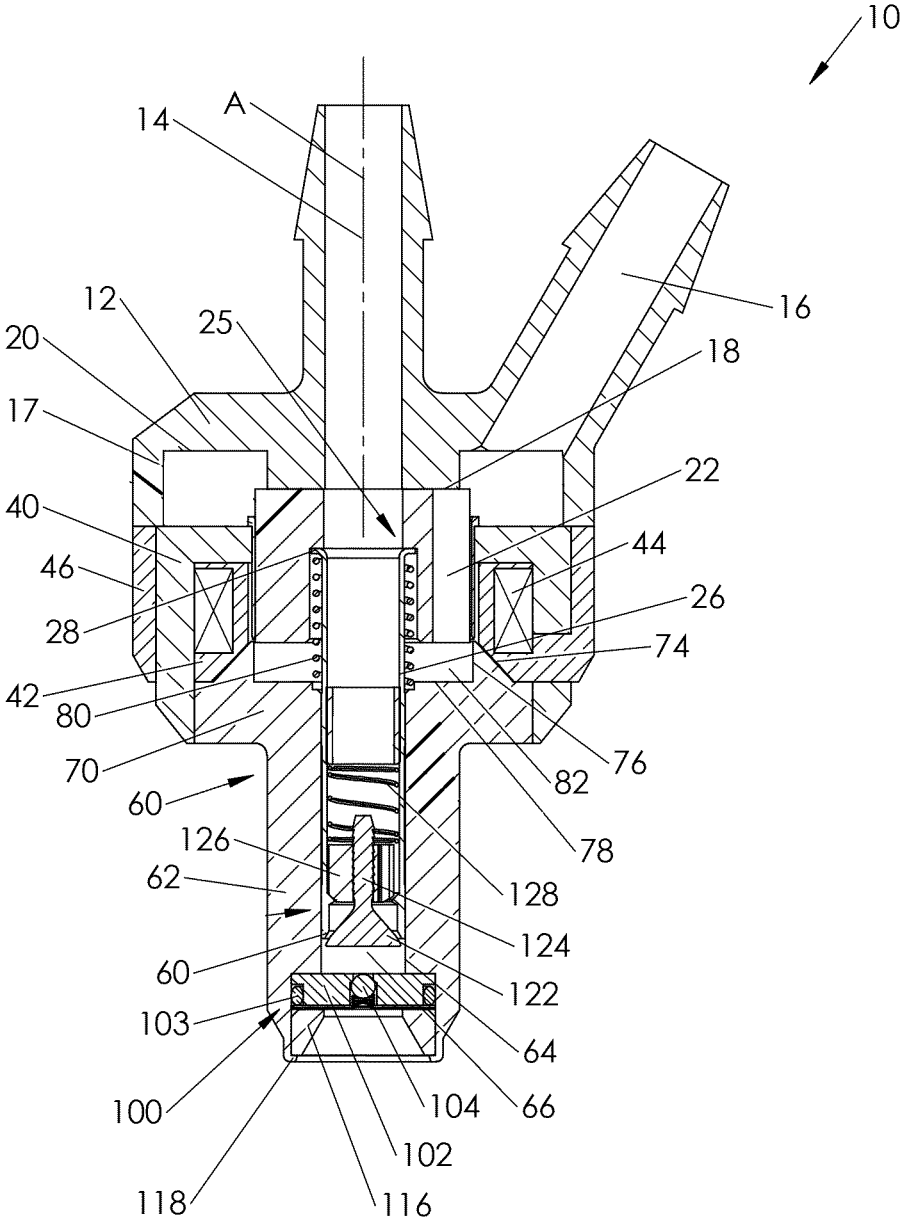
FIG. 1 is a cross-sectional view of a fuel injector according to an exemplary embodiment.
Figure 2:
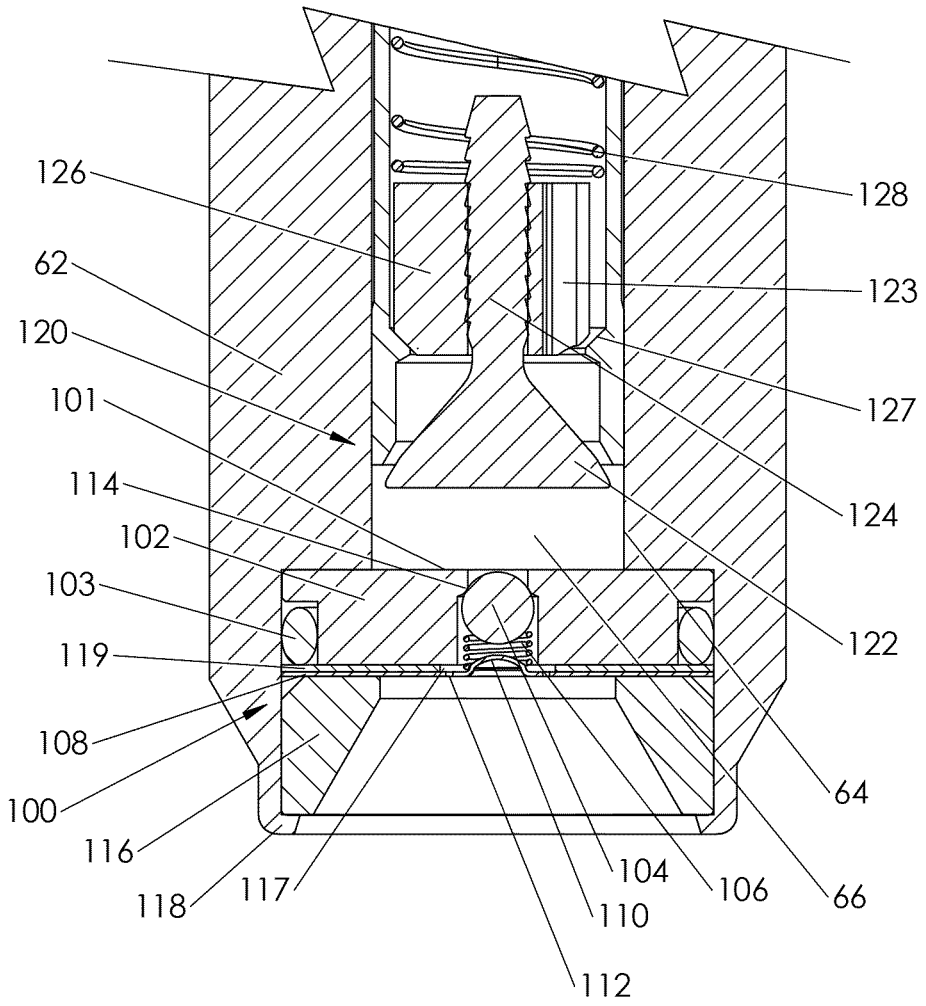
FIG. 2 is a cross-sectional view of an inlet valve, outlet check valve, and outlet nozzle of the fuel injector of FIG. 1.
Figure 3:
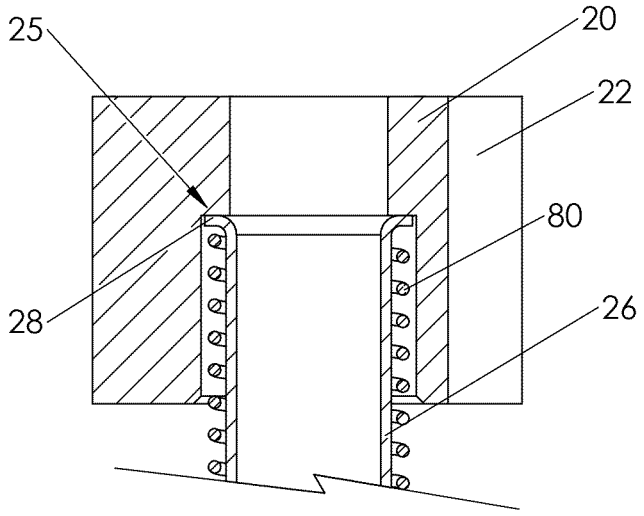
FIG. 3 is a cross-sectional view of an armature and piston interface of the fuel injector of FIG. 1.

Referring generally to the FIGURES, a fuel injector, and components thereof, are shown according to an exemplary embodiment. The fuel injector includes a reciprocating piston, an inlet valve, an outlet check valve, and a fluid pumping chamber. The fuel injector further includes a magnetic actuation assembly, which produces an electromagnetic force that drives the piston. Motion of the reciprocating piston in a direction that reduces the volume of the fluid pumping chamber forces fuel out of the injector. The inlet valve closes when the piston travels to reduce the volume of the fluid pumping chamber. Motion of the piston within the injector forces the fuel out through the orifice under pressure, thus negating the need for a separate fuel pump and pressure regulator, as required by conventional fuel injection systems. In this manner, the disclosed fuel injector can reduce the number of parts and components required in a typical fuel injection system application, which can significantly reduce manufacturing costs and simplify the assembly/manufacturing process.

The disclosed fuel injector may deliver fuel to the intake or directly into the combustion chamber of an internal combustion engine. While the fuel injector is described with respect to fuel and internal combustion engines, the disclosed fuel injector may be used with other fluids in other applications. For example, the injector may be used to spray or inject other liquids, for example, water, beverage, paint, ink, dye, lubricant, scented oil, or other types of fluids.

Before discussing further details of the fuel injection system and/or the components thereof, it should be noted that references to "top," "bottom," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIGS. 1-3, 6, and 7*a*, an injector 10 (e.g., sprayer, fuel injector, positive displacement pump, etc.) is shown according to an exemplary embodiment. The injector 10 includes a cap 12 defining a fuel inlet port 14, a fuel circulation port 16, and a fuel cavity 17. One or more fuel filters (not shown) may be installed at or near the fuel inlet port 14 and/or the fuel circulation port 16 to filter particulates from fuel before entering the injector 10, according to an exemplary embodiment. The cap 12 includes a face 18 on which an armature 20 is disposed. The armature 20 is shown to have at least one axial slot 22 to allow for the passage of fuel therethrough. According to other exemplary embodiments, the armature 20 may include one more additional axial slots to provide for a rotationally balanced armature 20. The injector 10 further includes a piston 26 positioned adjacent an armature 20 at an interface 25. The piston 26 includes a flange 28 that is engaged with a mating face 24 of the armature 20, such that the piston 26 is permitted to move only in a downward direction by the armature 20.

Figure 6:
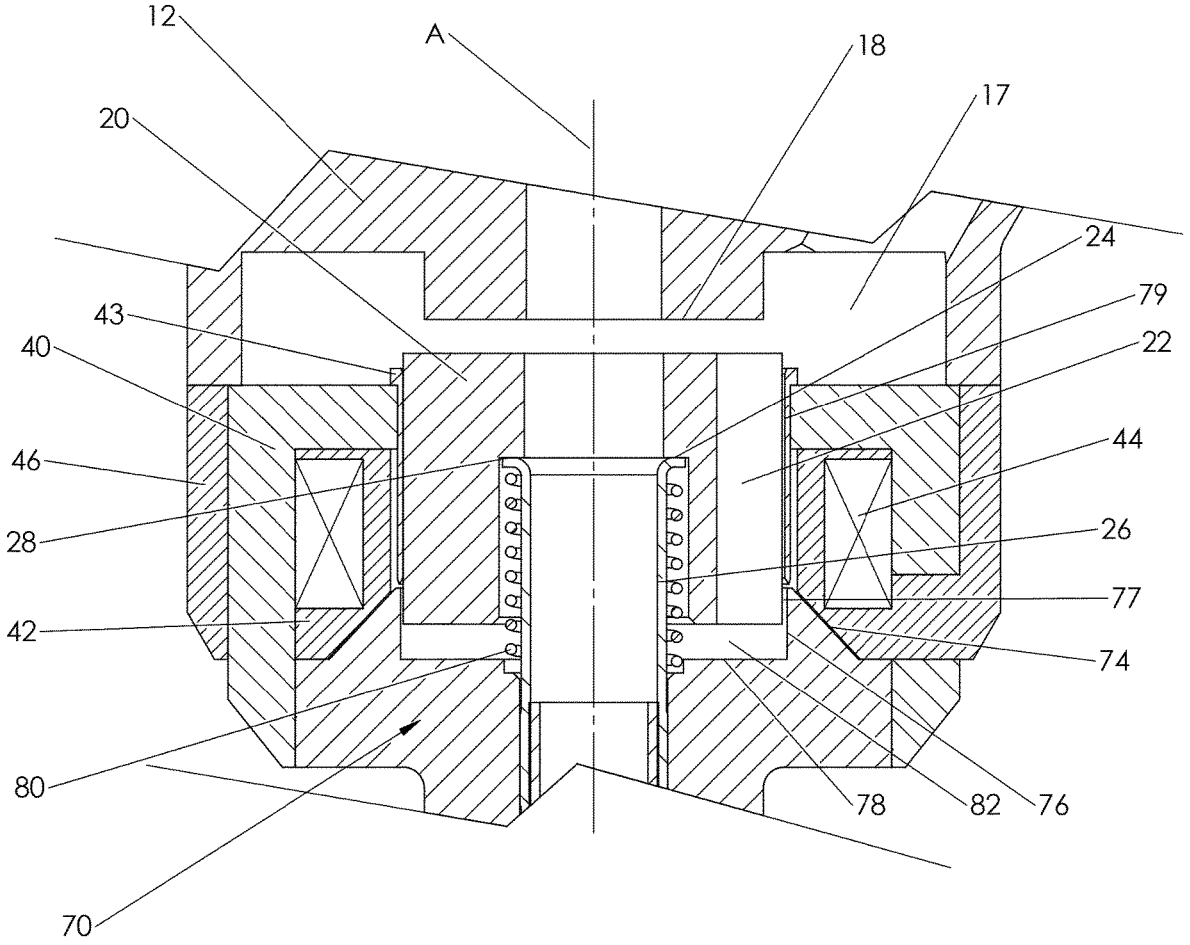
FIG. 6 is a cross-sectional view of an actuation assembly of the fuel injector of FIG. 1.

As shown in FIG. 6, a yoke 40 is coupled to the cap 12. The yoke 40 is configured to receive a bobbin 42 including a coil 44 wound from an enamel wire, according to an exemplary embodiment. The bobbin 42 is shown as being integrally formed with a casing 46. The bobbin 42 and casing 46 may be formed via an overmolding process to provide retention of the cap 12 with the yoke 40 and to provide sealing for the injector 10, according to an exemplary embodiment. According to other exemplary embodiments, the bobbin 42 is a separate component that is coupled to the casing 46. The yoke 40 can receive a body 60. The body 60 includes a lower body portion 62 and a core portion 70. The core portion 70 and yoke 40 collectively define the stator of the actuator. The core portion 70 includes a vertical face 76, which defines a first radial gap 77 relative to an outer periphery of the armature 20 through which a first magnetic flux line 71 can flow (see, for example, FIG. 7*a*). A second radial gap 79 is defined by an inner portion of the yoke 40 and an outer periphery of the armature 20. The core portion 70 includes a tapered face 74 at the periphery of the first radial gap 77. The tapered face 74 converges towards the second radial gap 79.

Still referring to FIG. 6, the core portion 70 includes a horizontal face 78. The horizontal face 78 and a lower surface of the armature 20 define an axial gap 82 through which a second magnetic flux line 73 can flow (see, for example, FIG. 7*a*). The first radial gap 77 and the second radial gap 79 are separated by a substantially non-magnetic material, according to an exemplary embodiment. According to other exemplary embodiments, the first radial gap 77 and the second radial gap 79 are separated by a space or cavity. The first magnetic flux line 71 and the second magnetic flux line 73 shown in FIG. 7*a* can also pass through the second radial gap 79. The lower body portion 62 and the core portion 70 of the body 60 are a unitary structure, according to the exemplary embodiment shown in the figures. According to other exemplary embodiments, the lower body portion 62 and the core portion 70 may be defined by a plurality of bodies coupled together.

As shown in FIG. 6, the yoke 40 can receive an armature sleeve 43 in which the armature 20 is slidingly received. The armature sleeve 43 can, advantageously, improve the useful life of the armature 20 and reduce the sideways force experienced by the armature. The armature 20, yoke 40, and core portion 70 may be made out of a magnetically permeable material or combination of materials, while the piston 26 may be made out of a material with a high magnetic reluctance, according to an exemplary embodiment. The armature 20, piston 26, yoke 40, bobbin 42, coil 44, and core portion 70 are shown aligned along a central axis "A" extending through the fuel inlet port 14. When the coil 44 is energized by an external driver, such as an electric power source, the interaction of the coil 44, armature 20, yoke 40, and core portion 70 produces a force causing the armature 20 and the piston 26 to move in a downward direction toward the core portion 70, thereby reducing the axial gap 82.

Figure 4:
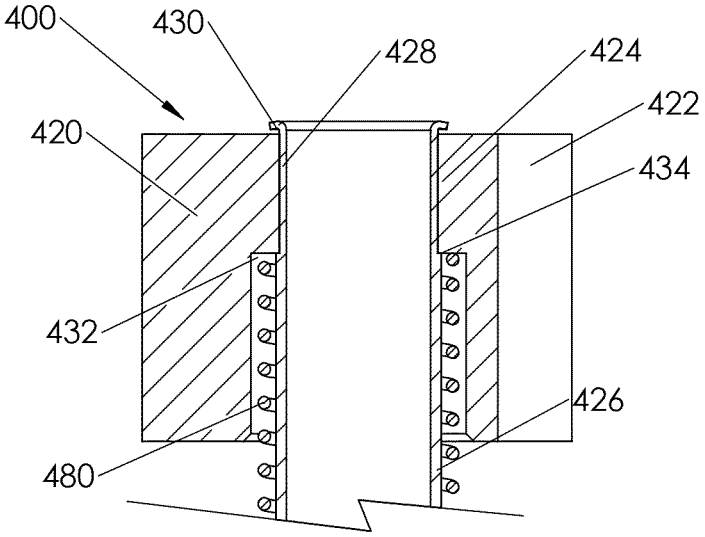
FIG. 4 is a cross-sectional view of an armature and piston interface of a fuel injector, according to another exemplary embodiment.

Referring to FIG. 4, an armature and piston interface 400 is shown according to another exemplary embodiment. The armature and piston interface 400 can, advantageously, be used in the fuel injector 10 shown in FIGS. 1 and 6 (e.g., armature 420 can replace armature 20, piston 426 can replace piston 26, etc.). In the embodiment of FIG. 4, an armature 420 is shown to have at least one axial slot 422 to allow fuel to pass therethrough. The armature 420 also includes a bore 424. A piston 426 including a reduced diameter section 428 is disposed in the bore 424 of armature 420. The bore 424 is defined by an inner wall of the armature 420. According to an exemplary embodiment, the section 428 may be spaced from the inner wall of the armature 420, so as to allow for relative movement between the piston 426 and the armature 420. A top portion of the piston 426 includes a flange 430, which can prevent upward motion of the armature 420 relative to the piston 426. The armature 420 includes a face 432 and a ledge 434 that can prevent upward motion of the piston 426 relative to the armature 420. A main spring 480 can bias against the armature 420 on the face 432.

Figure 5:
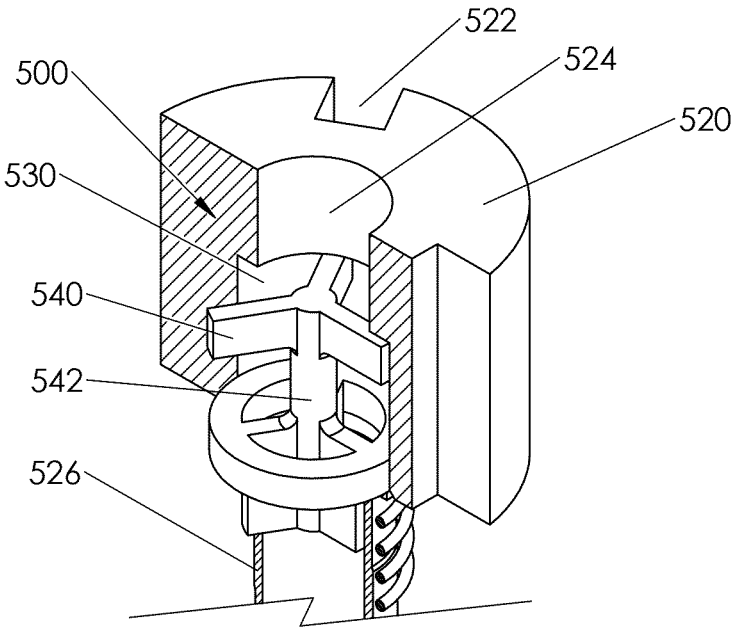
FIG. 5 is a partial perspective view of an armature and piston interface of a fuel injector, according to yet another exemplary embodiment.

Referring to FIG. 5, an armature and piston interface 500 is shown according to another exemplary embodiment. The armature and piston interface 500 can, advantageously, be used in the fuel injector 10 shown in FIGS. 1 and 6 (e.g., armature 520 can replace armature 20, piston 526 can replace piston 26, etc.). In the embodiment of FIG. 5, an armature 520 is shown to have at least one axial slot 522 to allow fuel to pass therethrough. The armature 520 further includes a bore 524 and a counterbore 530. A piston 526 is coupled to the armature 520 via a flexible member 540. The flexible member 540 includes an upper end engaged with the counterbore 530. The flexible member 540 further includes a middle section 542 and a bottom end which is mated to the piston 526. The middle section 542 is flexible and can bend to permit relative movement between the piston 526 and the armature 520. The flexible member 540 may be constructed of a flexible polymer or elastomer having flexible properties.

Figure 7A:
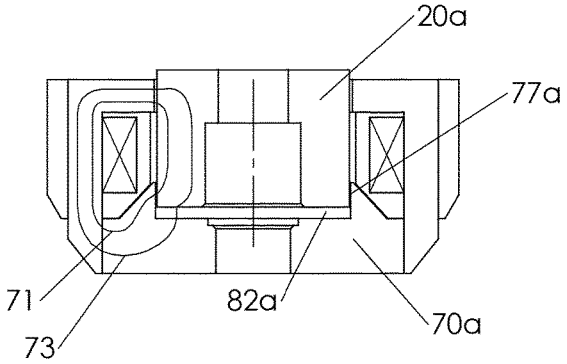
FIGS. 7*a*-7*d* are cross-sectional views of various actuation assemblies according to various exemplary embodiments.
Figure 7B:
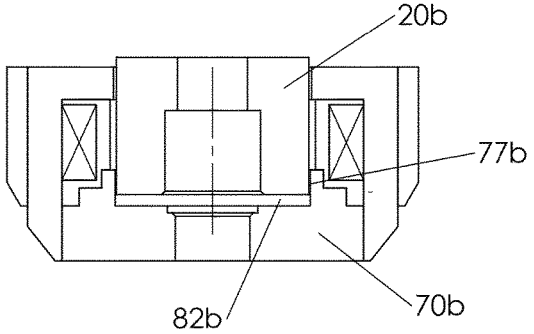
Figure 7C:
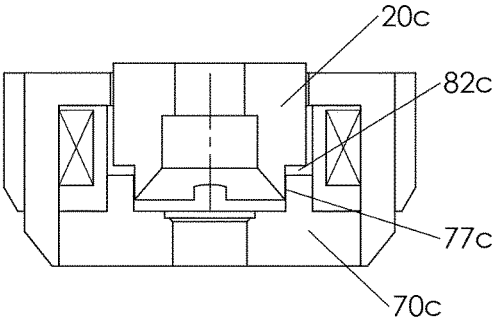
Figure 7D:
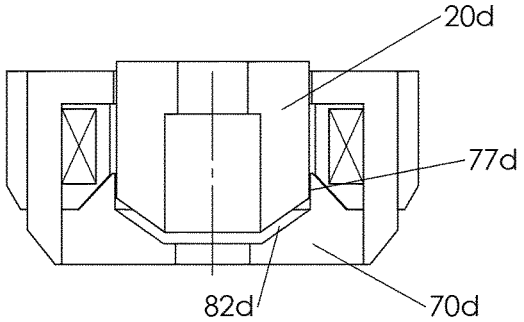

Referring to FIGS. 7*b*, 7*c*, and 7*d*, the armature 20, core portion 70, axial gap 82, and the first radial gap 77 are shown according to various exemplary embodiments, where like reference numerals refer to similar components between FIGS. 7*a*-7*d*, but vary by designation (e.g., core portion 70*a* in FIG. 7*a* is equivalent to core portion 70*b* in FIG. 7*b*, etc.). In the embodiments shown in FIGS. 7*b*-7*d*, the armature 20 and core portion 70 each have a different structural shape.

Referring again to FIGS. 1-3, 6, and 7*a*, a main spring 80 is located between the bottom of the flange 28 on the piston 26 and the body 60. The spring 80 biases the piston 26 towards the face 18 on the cap 12. According to another exemplary embodiment, the main spring 80 can bias the piston 26 towards the outlet check valve assembly 100. The upstroke or suction stroke of the piston 26 is initiated completely by the force produced by energizing the coil 44; whereas, the down stroke of the piston 26 can be powered by the main spring 80 (i.e., via the bias or return force of the spring). According to the embodiment shown, the piston 26 includes a substantially cylindrical wall having a first or top end, proximate the cap 12, and a second or bottom end, distal an outlet check valve assembly 100. The piston wall defines a longitudinal piston cavity through which fluid passes during the piston pumping cycle, i.e., the injection cycle. The bottom end of the piston 26 is shown to include an inlet valve seat 32 formed in the bottom end of the piston 26. The piston 26 is received in a piston bore 64 formed in the body 60. A pumping chamber 66 is defined by the bottom end of the piston 26, the piston bore 64, and the top of the outlet check valve assembly 100. The piston 26 is configured to pressurize fluid entering the pumping chamber 66.

An inlet valve assembly 120 is located at the bottom end of the piston 26 according to an exemplary embodiment. The inlet valve assembly 120 includes an inlet valve body 122 formed with an inlet valve stem 124, an inlet valve retainer 126, and an inlet valve spring 128. The inlet valve body 122 seals against the inlet valve seat 32. The inlet valve stem 124 is coupled to the inlet valve retainer 126. The inlet valve retainer 126 has at least one channel 123 to allow the passage of fuel into the pumping chamber 66. The inlet valve body 122 and the inlet valve seat 32 are both shown to have a tapered shape to provide self-alignment and improved sealing. The poppet design of the inlet valve of the exemplary embodiment provides a low volume of the pumping chamber 66 when the piston 26 is at the bottom of its travel, which improves high temperature operation of the injector 10. According to another exemplary embodiment, the inlet valve assembly 120 may be of another type other than the poppet design. For example, the inlet valve body 122 may be a sphere, flat plate, or reed. The inlet valve retainer 126 is received by, and axially translates within, the piston cavity. The inlet valve retainer 126 is attached to the inlet valve stem 124 and limits the travel of the inlet valve through contact of the shelf 127 on the inside of the piston 26. The inlet valve spring 128 is shown to bias the inlet valve assembly 120 into an open position. According to another exemplary embodiment, the inlet valve spring 128 may bias the inlet valve assembly 120 into a closed position or the inlet valve spring 128 may be omitted.

An advantage of an open inlet valve at the start of the injection cycle achieved by biasing of a spring member or by the momentum of the inlet valve body 122 is that any vapor present in the pumping chamber 66 is allowed to exit or be expelled therefrom. Another advantage of an open inlet valve at the start of injection is the current through the coil 44 can be used by the processing electronics to discern the amount of fluid available in the pumping chamber 66. This can, advantageously, be used to adjust the pulse width or prevent damage to the injector 10 when there is a lower than normal amount of fuel in the pumping chamber 66.

Still referring to FIGS. 1-3, 6, and 7*a*, an outlet check valve assembly 100 is located at or near a bottom of the lower body portion 62, according to an exemplary embodiment. The piston 26 can abut the top face 101 of the outlet valve seat 102 at the end of its travel. The piston 26 may reach the end of its travel before the axial gap 82 reaches zero, preventing the yoke 40, armature 20, and core portion 70 from saturating and retaining permanent magnetism. The outlet valve includes the outlet valve seat 102, sealing O-ring 103, an outlet valve body 104 (e.g., ball, check, etc.), an outlet valve spring 106, and a plate 108. The outlet valve body 104 is biased towards the outlet valve seat 102 by the outlet valve spring 106 which is supported by the plate 108 and aligned by an indent 110 formed on the plate 108. One or more orifices 112 on the plate 108 allow fuel to exit the injector 10 ideally in an atomized state once the outlet valve body 104 is separated from the outlet valve seat 102 (i.e. outlet check valve is open). According to the exemplary embodiment shown, the outlet valve body 104 is a polished sphere and the outlet valve seat 102 has a sealing surface 114, thereby ensuring self-alignment and a good seal. The sealing surface 114 may be formed by coining to provide a reliable seal while reducing manufacturing costs. According to the embodiment shown, a hole 117 formed in a plate 119 that is sandwiched between the plate 108 and outlet valve seat 102 provides a turbulent path for the fuel which increases atomization. According to other embodiments, the hole 117 may assume other shapes to affect the spray pattern of the injector 10.

A washer 116 is shown sandwiched between the plate 108 and a flange 118 at the bottom of the lower body portion 62. According to the exemplary embodiment shown, the flange 118 is formed to retain the outlet check valve assembly components. According to other exemplary embodiments, the outlet check valve assembly 100 may be affixed by other means, such as by plate 108 being welded to the lower body portion 62. According to other exemplary embodiments, outlet check valve designs other than those described above and shown in FIGS. 1 and 2 may also be used with the injector 10. For example, the outlet valve body 104 can have a variety of shapes, for example, flat plate, conical, poppet, mushroom, semi-spherical, etc. The outlet valve spring 106 can also be a resilient planar member, a spring washer, a solid flexible member, a conical helical spring, or the like.

A piston pumping cycle is described, according to an exemplary embodiment. As shown in FIG. 1, at the start of an injection event, the armature 20 is biased by the main spring 80 to a first or top position against the face 18. The processing electronics create a sufficient current in the coil 44 which produces a downward force on the armature 20 and a subsequent downward motion of the piston 26 to reduce the volume of the pumping chamber 66 and reduce the axial gap 82. Fuel present in the axial gap 82 can enter the cavity 17 through the axial slot 22 on the armature 20. When the inlet valve assembly 120 closes, the downward motion of the piston 26 generates positive pressure in the pumping chamber 66, which causes the outlet valve body 104 to move away from the outlet valve seat 102 and the outlet check valve assembly 100 to open. Fluid can move through the hole 117 and exit the injector 10 through the one or more orifices 112 at a high velocity.

When the current through the coil 44 is stopped by the processing electronics, the piston 26 loses velocity which causes the fluid pressure in the pumping chamber 66 to reduce, and the outlet check valve assembly 100 to close. The closing of the outlet check valve assembly 100 marks the end of an injection cycle. The main spring 80 can push the piston 26 and armature 20 upwards via a spring force. The inlet valve assembly 120 can then open due to relative negative pressure generated in the pumping chamber 66 by the movement of the piston 26, by the force of the inlet valve spring 128, by the upward motion of the piston 26 and momentum of the inlet valve body 122, or a combination of the three. Fuel can enter the pumping chamber 66 via the inlet valve assembly 120, and the injector 10 is primed for subsequent injections. According to an exemplary embodiment, the fuel inlet port 14 is aligned with axis A so that fuel directed towards the fuel injector 10 is introduced directly into the cavity in the piston 26, and eventually the pumping chamber 66 through the inlet valve assembly 120. Vapor generated in the injector 10 may exit through the fuel circulation port 16 through buoyancy or by the aid of a secondary pump (not shown).

An advantage of the armature 20, yoke 40, and core portion 70 disclosed herein is that they collectively provide a more constant force for when the armature 20 is received within the cone structure 72 of the core portion 70 than would be achieved without the cone structure 72. This flat force characteristic enables the fuel injector 10 to be calibrated more easily by providing a linear flow curve, reduces the part-to-part flow variation of the fuel injector, and reduces the fuel flow rate shift during its service life, particularly at high temperatures. The more constant force characteristic enables the flow rate to be less sensitive to the position of the armature 20 with respect to the other components, which may vary from part to part and shift over time due to wear. The topology of the core portion 70 design provides a more constant force by providing a parallel path to the axial-force producing second magnetic flux line 73 across axial gap 82. The first magnetic flux line 71 through the first radial gap 77 is parallel to the second magnetic flux line 73 through axial gap 82 due to the location of the two gaps at the same end of the armature 20. However, the first radial gap 77 does not produce as much useful force for moving the piston as the axial gap 82 does, which is due to the direction of the flux substantially in the radial direction. As the axial gap 82 is reduced in height by the movement of the armature 20, more of the magnetic flux is directed to the first radial gap 77 due to the widening of the tapered face 74, which maintains a more constant axial force for the armature.

According to other exemplary embodiments, the core portion 70 and armature 20 have shapes that provide parallel, substantially radial and substantially axial flux paths between the stator and the armature near the same end of the armature, such that the parallel radial flux increases as the axial gap is reduced. For example, FIG. 7*b* has a tapered face 74 of FIG. 6 replaced by a step so that the average flux through radial gap 77*b* is increased as the axial gap 82*d* is reduced. The embodiment of FIG. 7*c* has the cone portion located on the armature 20*c* instead of the core 70*c*. In other embodiments, one or both of the axial and radial gaps can have a tapered shape instead of strictly axial or radial, as long as the magnetic flux is diverted into at least two parallel paths which interact to produce a more constant force than would be otherwise achieved with a single flux path. For example, the embodiment of FIG. 7*d* has the lower face of the armature 20*d* and upper face of the core 70*d* assume a matching tapered face so that the gap 82*d* is conical while the radial gap 77*d* is still strictly radial. In other embodiments, the axial and radial gaps may be a single continuous gap which has an increasing amount of the flux therethrough directed into the radial direction by a tapered or roughly conical control-face such as face 74 of FIG. 6 as the armature moves axially to reduce the said gap in order to produce a substantially constant axial force A problem typically encountered with a solenoid type actuator, such as that shown in FIG. 1, is that there can be a high amount of magnetic side force of the armature 20 due to the eccentricity of the armature 20 with respect to the yoke 40 and core portion 70 (e.g., due to manufacturing tolerances and required clearances). This typically requires using a high grade surface finish and high tolerance of the sliding parts to reduce friction, which can be costly to produce. An advantage of the armature sleeve 43 is that it increases the radial gap between the armature 20 and the yoke 40, and reduces the sideways force imparted on the armature 20 when the coil 44 is energized. The armature sleeve 43 is preferably made of a material of high hardness and high magnetic reluctance. It is also advantageous to allow for some freedom of movement between the piston 26 and armature 20 while still allowing the armature 20 and piston 26 to impart vertical forces on each other for the upstroke and downstroke of the piston 26. The freedom of movement reduces the transfer of magnetic side force of the armature to the piston and piston bore interface, reducing the likelihood of binding and flow rate shift due to wear of the piston and bore over time.

The piston 26 and armature 20 of FIGS. 1-3, 6 are only constrained in one axial direction. This allows for freedom of movement between the piston 26 and the armature 20. In another embodiment, an elastomer washer may be placed between the piston 26 and armature 20 to allow for relative movement. The piston 426 and armature 420 of FIG. 4 is constrained in at least the two axial directions, but may be constrained a greater amount depending on the fit of the reduced diameter section 428 within the bore 424. The piston 526 and armature 520 of FIG. 5 is weakly constrained by a flexible member 540, but is relatively fixed in the axial direction. The interface 500 may provide advantages in high vibration environments where the greater freedom of movement of the piston interface 25 and certain configurations of the interface 400 may cause the piston and armature to rattle.

The circulation port 16 is advantageous for circulating heated liquid fuel and vapor out of the injector 10, because unlike traditional fuel injectors that only act as a valve while the fuel is pressurized upstream by a fuel pump, the injector 10 of the present application can operate with no upstream pump. As a result, the fuel inside the injector 10, particularly in cavity 17, may not be pressurized to a level where fuel can remain liquid at high operating temperatures. The actuator design of injector 10 also provides advantages in high temperature operation in that it provides a more constant force regardless of the height of the axial gap 82, which will keep the flow rate of fuel more consistent when the inlet valve 120 closes at different heights of the axial gap 82, depending on the amount of vapor present in the pumping chamber 66.

Another embodiment relates to a reciprocating piston pump for delivering fuel to an internal combustion engine including a solenoid actuator assembly, an outlet valve, an inlet valve, and a pumping chamber. The solenoid actuator assembly includes a fixed stator, a coil, and a movable armature. The movable armature is configured to move towards a first end of the stator when the coil is energized. The magnetic flux path of the energized solenoid actuator assembly passes substantially between the armature and stator via a radial gap and an axial gap and the surfaces that define the radial gap and the axial gap are located at the first end of the stator. The piston is configured to force fluid out of the outlet valve when the axial gap changes as the armature moves relative to the stator. The magnetic flux through the radial gap is increased as said axial gap height is reduced from the movement of the armature with respect to the stator as to produce a more constant total axial force on the armature for the portion of its range of travel intended to pressurize and pump fuel.

In some exemplary embodiments, the piston and armature are permitted movement with respect to each other at least in the radial direction or are joined by a flexible member.

In some exemplary embodiments, the piston and armature are fixed relative to each other in at least one of the axial directions.

In some embodiments, the piston pump forces pressurized fluid through a thin plate with one or more orifice holes.

In some exemplary embodiments, the outlet valve uses a helical spring to bias the valve body to a closed position.

In some exemplary embodiments, the inlet valve body assumes a poppet shape and the valve seat is attached to the piston.

In some exemplary embodiments, the armature's downward range of motion is restricted by the piston, and the piston reaches its downward travel limit before the armature.

In some exemplary embodiments, the armature has at least one axial slot to permit the passage of fuel therethrough.

In some exemplary embodiments, the inlet valve body is not biased towards the closed position by a spring member.

Another embodiment relates to a reciprocating piston pump for delivering fuel to an internal combustion engine comprising a solenoid actuator assembly, an outlet check valve, an inlet valve, and a pumping chamber. The solenoid actuator assembly includes a fixed stator, a coil, and a movable armature. The piston and armature are constrained relative to each other in at least one of the directions of the axis of travel of the armature and have at least one degree of freedom in another axis.

In some exemplary embodiments, the armature moves towards a first end of the stator when said coil is energized. The magnetic flux path of the energized solenoid actuator assembly passes substantially between the armature and stator via a radial gap and an axial gap and the surfaces that define the radial gap and the axial gap are located at the first end of the stator. The piston is configured to force fluid out of the outlet valve when the axial gap changes as the armature moves relative to the stator and the flow rate of the fluid is dependent on the electromagnetic force acting on the armature. The magnetic flux through the radial gap is increased as the axial gap height is reduced from the movement of the armature with respect to the stator as to produce a more constant total axial force on the armature for the portion of its range of travel intended to pressurize and pump fuel.

In some exemplary embodiments, the piston pump forces pressurized fluid through a thin plate with one or more orifice holes.

In some exemplary embodiments, the outlet valve uses a helical spring to bias the valve body to a closed position.

In some exemplary embodiments, the inlet valve body assumes a poppet shape and the valve seat is attached to the piston.

In some exemplary embodiments, the armature has at least one axial slot to permit the passage of fuel therethrough.

In some exemplary embodiments, the inlet valve body is not biased towards the closed position by a spring member.

Another embodiment relates to a reciprocating piston pump for delivering fuel to an internal combustion engine comprising a solenoid actuator assembly, an outlet check valve, an inlet valve, a pumping chamber, an outlet nozzle, an inlet port, and a circulation port. The solenoid actuator assembly is comprised of a fixed stator, a coil, and a movable armature. The outlet nozzle is configured to expel fuel at a high pressure or velocity. The inlet port and circulation port are configured to cycle fluid and vapor through the piston pump. The piston and armature are coupled together by a flexible member.

In some exemplary embodiments, the flexible member is axially stiff in the axis of travel of the armature and flexible in bending along same axis.

In some exemplary embodiments, the armature moves towards a first end of the stator and when the coil is energized. The magnetic flux path of the energized solenoid actuator assembly passes substantially between the armature and stator via a radial gap and an axial gap and the surfaces that define the radial gap and the axial gap are located at the first end of the stator. The piston forces fluid out of the outlet valve when the axial gap changes in size as the armature moves relative to the stator. The magnetic flux through the radial gap is increased as the axial gap height is reduced from the movement of the armature with respect to the stator as to produce a more constant total axial force on the armature for the portion of its range of travel intended to pressurize and pump fuel In some exemplary embodiments, the piston pump forces pressurized fluid through a thin plate with one or more orifice holes.

In some exemplary embodiments, the outlet valve uses a helical spring to bias the valve body to a closed position.

In some exemplary embodiments, the inlet valve body assumes a poppet shape, and the valve seat is coupled to the piston.

The construction and arrangement of the elements of the fuel injection system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents, but also equivalent structures. Other substitutions, modifications, changes and omissions may be made in the design, operating configuration, and arrangement of the preferred and other exemplary embodiments without departing from the scope of the appended claims.

What is claimed is:

1. A reciprocating piston pump for delivering fuel to an internal combustion engine, comprising:

a pumping chamber;

an inlet valve configured to allow fuel to enter the pumping chamber;

a piston configured to pressurize the fuel entering the pumping chamber;

an outlet valve configured to allow the pressurized fuel to exit the pumping chamber; and a solenoid actuator assembly coupled to the piston, wherein the solenoid actuator assembly comprises:

a fixed stator comprising a coil; and a movable armature, wherein the movable armature is configured to move toward a first end of the fixed stator in response to the coil being energized;

wherein the solenoid actuator assembly includes a magnetic flux path that passes substantially between the movable armature and the fixed stator via a radial gap and an axial gap that are defined at least in part by the first end of the stator;

wherein the movable armature is configured to move relative to the fixed stator to reduce the axial gap and to increase a magnetic flux through the radial gap such that a total axial force acting on the movable armature is substantially constant through a portion of travel of the movable armature; and wherein the piston is configured to move to force the pressurized fuel out of the outlet valve in response to the axial gap being reduced; and wherein the movable armature is biased away from the outlet valve by a spring acting directly against the piston.

2. The reciprocating piston pump of claim 1, wherein the piston and the movable armature are configured to move relative to each other in a radial direction.

3. The reciprocating piston pump of claim 1, wherein the piston and the movable armature are fixed relative to each other in an axial direction.

4. The reciprocating piston pump of claim 1, further comprising a plate in fluid communication with the pumping chamber and including one or more orifices, wherein the piston is configured to move pressurized fuel through the one or more orifices of the plate.

5. The reciprocating piston pump of claim 1, wherein the outlet valve includes a helical spring configured to bias the outlet valve to a normally closed position.

6. The reciprocating piston pump of claim 1, wherein the inlet valve includes a valve body and a valve seat, and wherein the valve body and the valve seat are coupled to the piston.

7. The reciprocating piston pump of claim 1, wherein the piston is configured to limit movement of the armature, and wherein the piston is configured to reach a downward limit before the armature.

8. The reciprocating piston pump of claim 1, wherein the armature includes at least one axial slot to permit fuel to pass therethrough.

9. The reciprocating piston pump of claim 1, wherein the inlet valve includes a valve body that is biased by a spring member to a normally open position.

10. The reciprocating piston pump of claim 1, wherein the reciprocating piston pump is configured such that the average cross-sectional area of the radial gap adjacent the fixed stator increases as the movable armature moves to reduce the axial gap.

11. The reciprocating piston pump of claim 1, wherein the reciprocating piston pump is configured such that the fixed stator becomes less magnetically saturated as the movable armature moves to reduce the axial gap.

12. A reciprocating piston pump for delivering fuel to an internal combustion engine, comprising:

a pumping chamber;

an inlet valve through which fuel passes to enter the pumping chamber;

a piston configured to pressurize the fuel entering the pumping chamber;

an outlet valve through which the pressurized fuel passes to exit the pumping chamber; and a solenoid actuator assembly configured to move the piston, wherein the solenoid actuator assembly comprises:

a fixed stator comprising a coil; and a movable armature configured to move relative to the fixed stator in response to the coil being energized;

wherein the movable armature is biased away from the outlet valve by a spring acting directly against the piston;

wherein the piston and the movable armature are configured to move relative to each other in a radial direction; and wherein the piston and the movable armature are fixed relative to each other in an axial direction.

13. The reciprocating piston pump of claim 12, wherein the solenoid actuator assembly includes a magnetic flux path that passes substantially between the movable armature and the fixed stator via a radial gap and an axial gap, wherein the radial gap and the axial gap are defined at least in part by one or more surfaces of the fixed stator, wherein the piston is configured to force the pressurized fuel out of the outlet valve in response to the axial gap changing in size as the movable armature moves relative to the fixed stator, and wherein the movable armature is configured to move relative to the fixed stator to reduce the axial gap and to increase a magnetic flux through the radial gap such that a total axial force acting on the movable armature is substantially constant through a portion of travel of the movable armature.

14. The reciprocating piston pump of claim 12, further comprising a plate in fluid communication with the pumping chamber and including one or more orifices, wherein the piston is configured to force pressurized fuel through the one or more orifices.

15. The reciprocating piston pump of claim 12, wherein the outlet valve includes a helical spring configured to bias the outlet valve to a normally closed position.

16. The reciprocating piston pump of claim 12, wherein the inlet valve includes a valve body and a valve seat, and wherein the valve body and the valve seat are coupled to the piston.

17. The reciprocating piston pump of claim 12, wherein the movable armature includes at least one axial slot to permit fuel to pass therethrough.

18. The reciprocating piston pump of claim 12, wherein the inlet valve includes a valve body that is biased by a spring member to a normally open position.

19. The reciprocating piston pump of claim 12, wherein the reciprocating piston pump is configured such that the average cross-sectional area of the radial gap adjacent the stator increases as the movable armature moves to reduce the axial gap.

20. The reciprocating piston pump of claim 12, wherein the reciprocating piston pump is configured such that the stator becomes less magnetically saturated as the movable armature moves to reduce the axial gap.

* * * * *